US007957685B2

(12) United States Patent
Shimizu

(10) Patent No.: US 7,957,685 B2
(45) Date of Patent: Jun. 7, 2011

(54) GUIDE MEMBER, ENDLESS BELT, METHOD OF PRODUCING ENDLESS BELT, AND IMAGE FORMING APPARATUS USING ENDLESS BELT

(75) Inventor: Masakazu Shimizu, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 352 days.

(21) Appl. No.: 12/174,355

(22) Filed: Jul. 16, 2008

(65) Prior Publication Data

US 2009/0084498 A1 Apr. 2, 2009

(30) Foreign Application Priority Data

Oct. 2, 2007 (JP) ..... 2007-258875

(51) Int. Cl.
*G03G 15/20* (2006.01)

(52) U.S. Cl. ..... 399/308; 399/313

(58) Field of Classification Search ..... 399/162, 399/165, 303, 312, 313, 302, 308; 198/818, 198/819, 821, 837, 840, 846, 844.1, 835
See application file for complete search history.

(56) References Cited

U.S. PATENT DOCUMENTS

| | | | | |
|---|---|---|---|---|
| 779,981 | A * | 1/1905 | White | 198/840 |
| 3,661,245 | A * | 5/1972 | Mol et al. | 198/688.1 |
| 6,137,983 | A * | 10/2000 | Okabayashi et al. | |
| 7,684,741 | B2 * | 3/2010 | Sawai | 399/302 |
| 7,711,297 | B2 * | 5/2010 | Kawatani et al. | 399/302 |
| 2003/0035661 | A1 * | 2/2003 | Kabata et al. | 399/162 |
| 2005/0095041 | A1 * | 5/2005 | Kim et al. | 399/302 |
| 2008/0003024 | A1 * | 1/2008 | Sawai | 399/308 |

FOREIGN PATENT DOCUMENTS

| | | |
|---|---|---|
| JP | A 58-100145 | 6/1983 |
| JP | A 4-333457 | 11/1992 |
| JP | A 7-187435 | 7/1995 |
| JP | A 9-150817 | 6/1997 |
| JP | A 10-86232 | 4/1998 |
| JP | A 2000-122439 | 4/2000 |
| JP | A 2001-206522 | 7/2001 |
| JP | A-2003-295627 | 10/2003 |
| JP | A 2004-53629 | 2/2004 |

OTHER PUBLICATIONS

Mar. 2, 2010 Office Action issued in Japanese Patent Application No. 2007-258875 (with translation).

* cited by examiner

*Primary Examiner* — Susan S Lee
(74) *Attorney, Agent, or Firm* — Oliff & Berridge, PLC

(57) ABSTRACT

An endless belt 300 includes an endless belt substrate 10, and a guide member 100 having a rib member 20 and an abutment that is abutted against an edge of the endless belt substrate 10, wherein the abutment of the guide member 100 is abutted against at least one edge surface of the endless belt substrate 10. Further, the guide member 100 may be provided on at least one edge surface of the endless belt substrate 10 with an adhesive layer 30 disposed therebetween. The abutment of the guide member 100 may include a contact surface 41 that contacts the edge surface of the endless belt substrate 10, an extended section 43 that extends beyond the edge of the endless belt substrate 100, and a support surface that contacts one side of the endless belt substrate 10. Moreover, a reinforcing tape 50 may be bonded across the other side of the endless belt substrate 10 and the short width surface of the extended section 43 of the guide member 100.

16 Claims, 10 Drawing Sheets

GUIDE MEMBER, ENDLESS BELT, METHOD OF PRODUCING ENDLESS BELT, AND IMAGE FORMING APPARATUS USING ENDLESS BELT

CROSS-REFERENCE TO RELATED APPLICATIONS

This application is based on and claims priority under 35 USC 119 from Japanese Patent Application No. 2007-258875, filed on Oct. 2, 2007.

BACKGROUND

1. Technical Field

The present invention relates to a guide member, an endless belt, a method of producing the endless belt, and an image forming apparatus that uses the endless belt.

2. Related Art

In electrophotographic image forming apparatuses, endless belts are used as intermediate transfer belts for transferring a toner image to a final transfer material using an electrophotographic process, and as a transfer material transport belt for transporting the final transfer material.

A running device containing an endless belt such as a photoreceptor belt, an intermediate transfer belt or a paper transport belt in an image forming apparatus is typically configured, for example, in the manner shown in FIG. 11, with an endless belt 1 stretched tightly around three rollers 3. One of these rollers 3 functions as the drive roller, and the other two rollers are driven rollers, and the endless belt 1 is designed to run between these rollers.

In these types of endless belt running devices, methods that have been proposed to prevent the belt from meandering from side to side include methods in which a flange is provided on the drive roller or the like, and methods in which, as shown in FIG. 12, a strap-shaped meander prevention rib member 2 that undergoes ready elastic deformation is provided on the inner surface on at least one side edge of the endless belt 1, and by bringing the edge of this rib member 2 into contact with a tapered guide surface of a guide roller 7, which is provided in a freely rotatable arrangement on the outside of a roller 3 that is driven by a rotational shaft 6, the travel of the endless belt 1 can be guided.

In the case of the rib member 2 described in the latter method, as can be seen in FIG. 13, which represents an enlargement of a region Z encircled by a dotted line in the vicinity of the rib member 2 in FIG. 12, a rib section 4 is bonded to the endless belt 1 using an adhesive section 5.

SUMMARY

A guide member, an endless belt, a method of producing the endless belt, and an image forming apparatus that uses the endless belt according to the present invention have the features described below.

(1) According to an aspect of the present invention, there is provided a guide member having a rib member, and a base that has the rib member provided on one surface thereof and has a surface that contacts an edge of a target object.

BRIEF DESCRIPTION OF THE DRAWINGS

Exemplary embodiment(s) of an aspect of the present invention will be described in detail based on the following figures, wherein.

DETAILED DESCRIPTION

[Guide Member]

Figure 1:
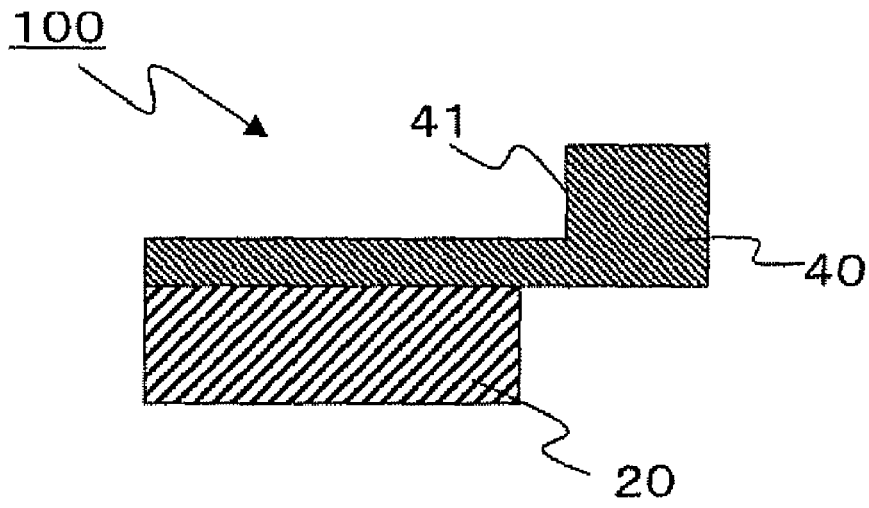
FIG. 1 is a schematic cross-sectional view showing an example of a guide member according to an exemplary embodiment of the present invention.
Figure 12:
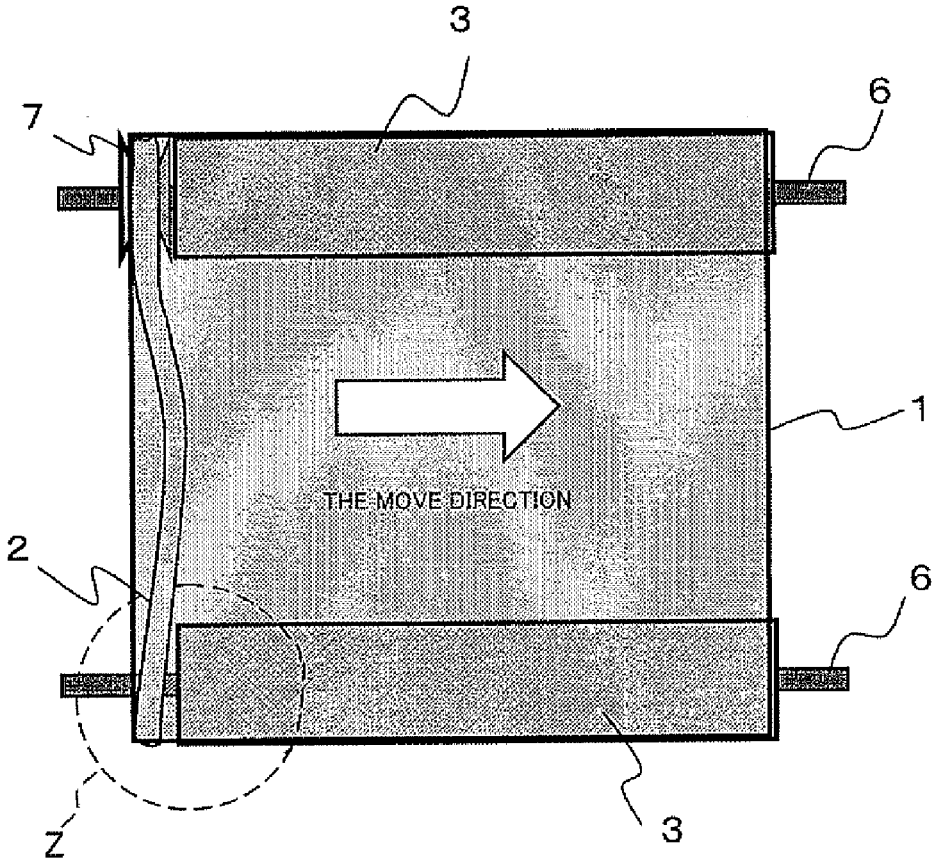
FIG. 12 is a schematic illustration describing an example of a meander prevention structure for an endless belt.
Figure 13:
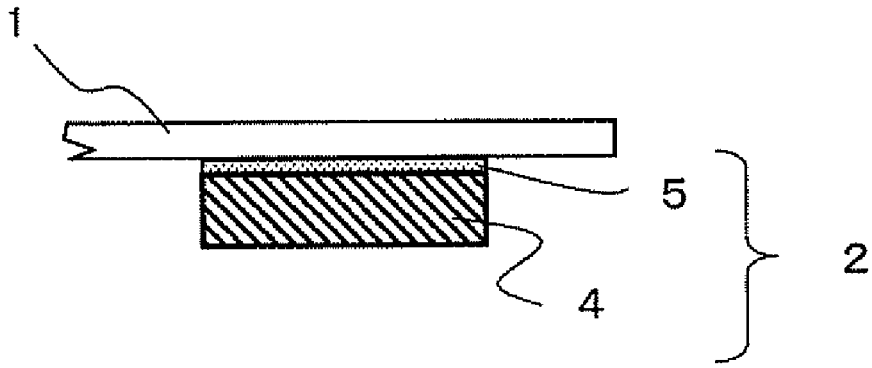
FIG. 13 is a partial expanded cross-sectional view of the endless belt of FIG. 12, showing the region Z encircled by a dotted line in FIG. 12.

As shown in the cross-sectional structure of FIG. 1, a guide member 100 of an exemplary embodiment of the present invention has a rib member 20, and a base 40, that has the rib member 20 provided on one surface thereof, has a contact surface 41 that contacts an edge of a target object, and is able to be positioned relative to, and then bonded to, the target object for the rib member 20. In this description, the "rib member" refers to a strap-shaped meander prevention member that undergoes ready elastic deformation, which, as shown in FIG. 12 and as mentioned above, is provided on the inner surface of at least one side edge of the endless belt 1, and wherein by bringing the edge of this rib member into contact with a tapered guide surface of a guide roller 7, which is provided in a freely rotatable arrangement on the outside of a roller 3 driven by a rotational shaft 6, the travel of the endless belt 1 can be guided. Furthermore, in this description, the "guide member" refers to a member that is used to ensure that the above rib member can be provided at a predetermined position at the side edge of the endless belt 1.

In the guide member 100 of this exemplary embodiment, the degree of parallelism between the edge surface of the rib member 20 and the contact surface 41 is not more than approximately 0.3 mm. Moreover, the maximum thickness of the base 40 in this exemplary embodiment is not less than approximately 40 μm and not more than approximately [the thickness of the target object+200 μm], the minimum thickness of the base 40 is not less than approximately 20 μm and not more than approximately 200 μm, and the contact surface 41 of the guide member 100 that contacts the edge surface of the target object has a height that is not less than approximately 20 μm and not more than approximately the thickness of the target object.

Furthermore, the base 40 may use an elastic member, and in terms of the tensile elasticity and the heat resistance, biaxially oriented polyester, fluororesin, polyamide resin or polypropylene or the like can be used. Moreover, in order to form the cross-sectional shape shown in FIG. 1, the base 40 may be formed, for example, by using a single sheet of an elastic member, and cutting this sheet at a specified width and to a predetermined depth. However, the present invention is not restricted to this method of formation, and the base 40 may also be formed, for example, by extrusion molding.

Furthermore, if required, an adhesive may be used to effect bonding at the interface between the rib member 20 and the base 40.

The type A durometer hardness of the rib member 20, measured in accordance with JIS K6253 (1997), is typically not less than approximately A30 and not more than approximately A90, and is preferably not less than approximately A50 and not more than approximately A80, and even more preferably not less than approximately A65 and not more than approximately A75. Examples of materials that may be used for the elastic member used in the rib member 20 include elastic materials and the like having a suitable degree of hardness, such as neoprene rubbers, polyurethane rubbers, silicon rubbers, polyester elastomers, chloroprene rubbers and nitrile rubbers. Of these, if due consideration is also given to factors such as the electrical insulation properties relative to the endless belt substrate 10, as well as the moisture resistance, solvent resistance, ozone resistance, heat resistance, abrasion resistance, and the adhesion to adhesives, then polyurethane rubbers and nitrile rubbers are particularly preferred. In terms of the shape of the rib member 20, the cross-section is preferably a substantially rectangular shape, but trapezoidal shapes and semicircular shapes are also possible, and this does not constitute an exhaustive list. Furthermore, in terms of factors such as the meander prevention effect and the durability and the like, the width of the rib member 20 is typically not less than approximately 3 mm and not more than approximately 10 mm, and is even more preferably not less than approximately 3 mm and not more than approximately 7 mm. There are no particular restrictions on the thickness of the rib member 20, although typically, a thickness of not less than approximately 1 mm and not more than approximately 5 mm is preferred.

Figure 2:
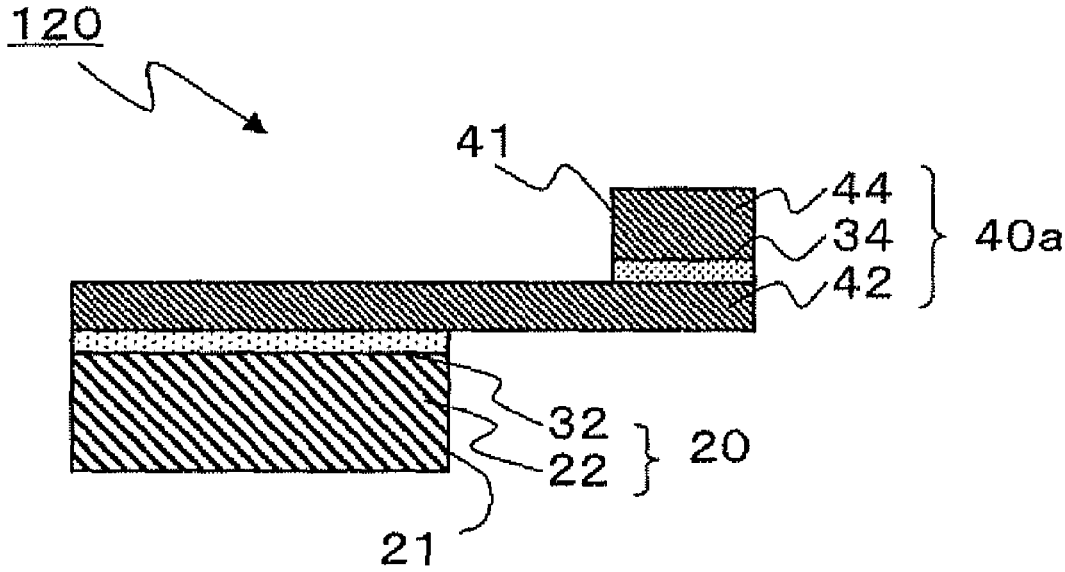
FIG. 2 is a schematic cross-sectional view showing another example of a guide member according to an exemplary embodiment of the present invention.

As shown in the cross-sectional structure of FIG. 2, another guide member 120 according to an exemplary embodiment of the present invention has a rib member 20 composed of a rib elastic member 22 and an adhesive layer 32, and a base 40*a*, that has the rib member 20 provided on one surface thereof, has a contact surface 41 that contacts an edge of a target object, and is able to be positioned relative to, and then bonded to, the rib member 20. The base 40*a* is composed of a first film 44 that includes the contact surface 41 that contacts the edge surface of the target object, and a second film 42 that contacts one surface of the first film 44 via an adhesive layer 34, and also has a surface that contacts one side of the target object.

In this other guide member 120 according to this exemplary embodiment, the thickness of the second film 42 is not less than approximately 20 μm and not more than approximately 200 μm, and the thickness of the first film 44 is not less than approximately 20 μm and not more than approximately the thickness of the endless belt substrate. Moreover, the degree of parallelism between the edge surface of the rib member 20 provided on this other guide member 120 according to this exemplary embodiment, and the edge surface 41 of the first film 44 is not more than approximately 0.3 mm.

Further, the type A durometer hardness of the rib elastic member 22 of the rib member 20, measured in accordance with JIS K6253 (1997), is typically not less than approximately A30 and not more than approximately A90, and is preferably not less than approximately A50 and not more than approximately A80, and even more preferably not less than approximately A65 and not more than approximately A75. Examples of materials that may be used for the elastic member used in the rib member 20 include elastic materials and the like having a suitable degree of hardness, such as neoprene rubbers, polyurethane rubbers, silicon rubbers, polyester elastomers, chloroprene rubbers and nitrite rubbers. Of these, if due consideration is also given to factors such as the electrical insulation properties relative to the endless belt substrate, as well as the moisture resistance, solvent resistance, ozone resistance, heat resistance, abrasion resistance, and the adhesion to adhesives, then polyurethane rubbers and nitrile rubbers are particularly preferred. In terms of the shape of the rib member 20, the cross-section is preferably a substantially rectangular shape, but trapezoidal shapes and semicircular shapes are also possible, and this does not constitute an exhaustive list. Furthermore, in terms of factors such as the meander prevention effect and the durability and the like, the width of the rib member 20 is typically not less than approximately 3 mm and not more than approximately 10 mm, and is even more preferably not less than approximately 3 mm and not more than approximately 7 mm. There are no particular restrictions on the thickness of the rib member 20, although typically, a thickness of not less than approximately 1 mm and not more than approximately 5 mm is preferred.

The adhesive layer 32 of the rib member 20 preferably employs an acrylic-based, natural rubber-based, synthetic rubber-based, silicone-based or thermosetting adhesive. Of these, in terms of the adhesion achieved and the cost incurred, acrylic-based adhesives are particularly desirable. The film thickness of the adhesive (the thickness of the adhesive layer) is preferably not less than approximately 5 μm and not more than approximately 100 μm, and is even more preferably not less than approximately 10 μm and not more than approximately 50 μm. If this thickness exceeds approximately 100 μm, then there is a possibility of the adhesive protruding beyond the bonded area. Furthermore, if the thickness is less than approximately 5 μm, then the adhesive strength between the rib elastic member 22 and the second film 42 of the base 40*a* may be inadequate.

Furthermore, double-coated adhesive tapes composed of an adhesive containing, as a main constituent, a resin-based material such as an acrylic material, silicone material, natural or synthetic rubber, urethane material or a synthetic resin material such as a vinyl chloride-vinyl acetate copolymer, and a nonwoven fabric, a polyester film or a polyimide film or the like may also be used. An example of a commercially available Double-coated Adhesive Tape is the product No. 5000NS, manufactured by Nitto Denko Corporation, which includes acrylic resin-based adhesive layers with a thickness of 0.03 mm formed on both sides of a nonwoven fabric substrate with a thickness of 0.1 mm.

Further, in terms of achieving favorable tensile elasticity and heat resistance, the first film 44 and the second film 42 may use biaxially oriented polyester, fluororesin, polyamide resin or polypropylene or the like.

Figure 14:
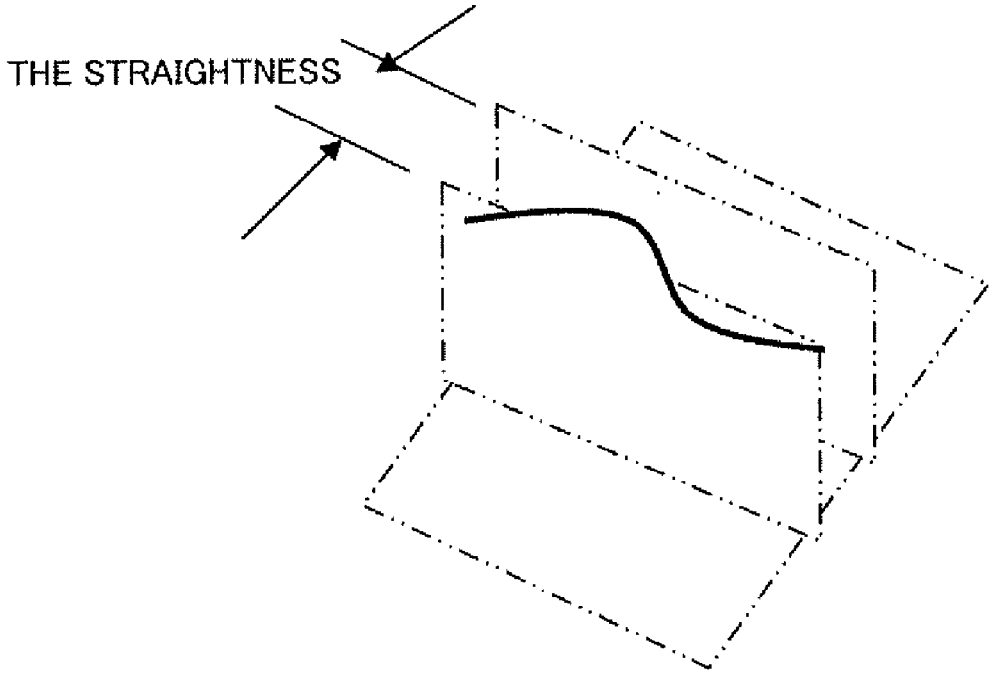
FIG. 14 is an illustration describing the concept of straightness.

Moreover, from the viewpoint of toughness, the thickness of the first film 44 is preferably substantially equal to the thickness of the target object (for example, the endless belt substrate), and if not substantially equal, is preferably not less than approximately 20 μm. If the thickness of the first film 44 is less than approximately 20 μm, then the operation of abutting the film against the edge of the target object may tend to become problematic. The width of the first film 44 is preferably not less than approximately 1 mm and not more than approximately 10 mm, and is even more preferably not less than approximately 2 mm and not more than approximately 5 mm. The straightness of the edge of the first film 44 is preferably not more than approximately 0.5 mm, and is even more preferably approximately 0.2 mm or less. Here, the "straightness" is based upon the "straightness" defined in the "Definitions and Indications of Geometric Deviation" described in JIS B0621. In other words, referring to FIG. 14, the property of straightness in an exemplary embodiment of the present invention refers to the size of the deviation of a linear form from a geometrically correct straight line (a geometric straight line), so that when a pair of geometrically correct parallel planes that are perpendicular to the above deviation are used to sandwich the linear form, the straightness refers to the minimum spacing between the two planes.

Measurement of the straightness may be conducted, for example, by using a 3D Coordinate Measuring Machine (CP-1057, manufactured by Mitutoyo Corporation) to measure the displacement of the rib member 20 (FIG. 2) using the two ends of the rib member 20 (FIG. 2) as reference points, and then calculating the straightness.

If the width of the first film 44 is less than approximately 1 mm, then the operation of abutting the film against the edge of the target object (for example, the endless belt substrate) may tend to become problematic, and ensuring that the straightness of the edge of the film is not more than approximately 0.5 mm may become difficult, whereas if the width of the film exceeds approximately 10 mm, then there is a possibility that the target object with the guide member 120 bonded thereto may occupy too much space inside the apparatus. In terms of toughness, the first film 44 preferably uses a portion of the target object (for example, a portion of the endless belt substrate).

In terms of achieving favorable tensile elasticity and heat resistance, the second film 42 is preferably formed from the material of the target object (for example, the endless belt substrate) or biaxially oriented polyester. The thickness of the second film 42 is preferably not less than approximately 10 μm and not more than approximately 200 μm, and is even more preferably not less than approximately 20 μm and not more than approximately 130 μm. If the thickness exceeds approximately 200 μm, then the shearing force that acts between the target object and the second film may become concentrated within the target object, causing cracking. In contrast, if the thickness is less than approximately 10 μm, then the workability may deteriorate during adhesion to the target object, which may cause positional displacement of the base 40*a*. The width of the second film 42, which includes the widths of the first film 44 and the rib member 20, preferably adds an additional width of not less than 0 mm and not more than approximately 3 mm.

In a similar manner to the above adhesive layer 32, the adhesive layer 34 is preferably an acrylic-based, natural rubber-based, synthetic rubber-based, silicone-based or thermosetting adhesive. Of these, in terms of the adhesion achieved and the cost incurred, acrylic-based adhesives are particularly desirable. The film thickness of the adhesive (the thickness of the adhesive layer) is preferably not less than approximately 5 μm and not more than approximately 100 μm, and is even more preferably not less than approximately 10 μm and not more than approximately 50 μm. If this thickness exceeds approximately 100 μm, then there is a possibility of the adhesive protruding beyond the bonded area. Furthermore, if the thickness is less than approximately 5 μm, then the adhesive strength may be inadequate.

In order to ensure that, as described above, the degree of parallelism between the rib member 20 provided on the guide member 120 and the edge surface 41 of the first film 44 is not more than approximately 0.3 mm, besides the method shown in FIG. 2 in which the first film 44 and the second film 42 are bonded together, a method in which the first film 44 and the second film 42 are welded together may also be used.

[Endless Belt]

Next is a description of an endless belt according to an exemplary embodiment of the present invention, with reference to FIG. 3 through FIG. 6. Descriptions of those structures which are the same as structural elements of the guide members 100 and 120 described using FIG. 1 and FIG. 2 are omitted here. Further, in the endless belt described below, structural elements bearing the same symbols as above are deemed to have the same structure, and their descriptions are therefore omitted.

Figure 3:
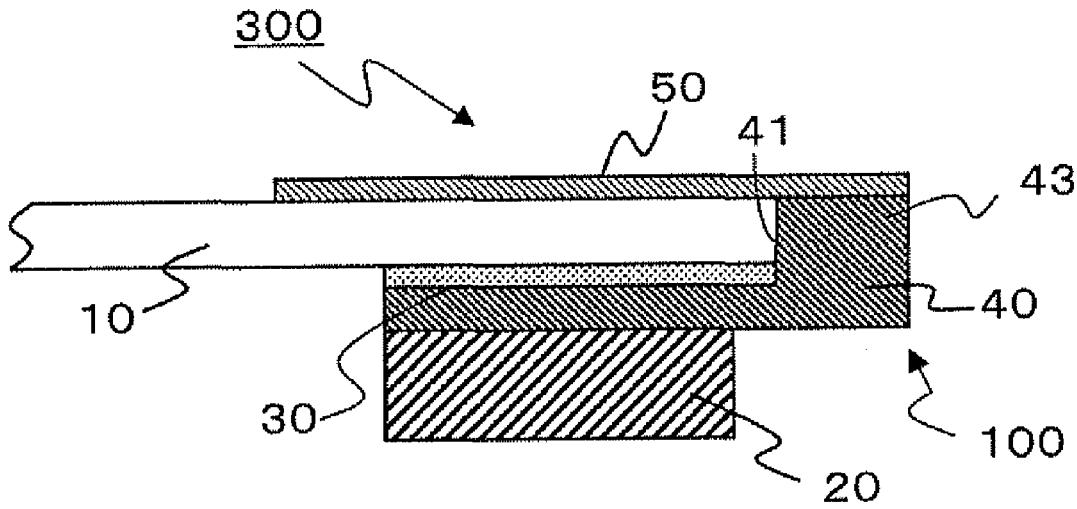
FIG. 3 is a schematic cross-sectional view showing an example of an endless belt according to an exemplary embodiment of the present invention.

An endless belt 300 according to an exemplary embodiment of the present invention shown in FIG. 3 includes an endless belt substrate 10, and a guide member 100 that is provided with a rib member 20 and also has an abutment that is abutted against an edge of the endless belt substrate 10, wherein the abutment of the guide member 100 is abutted against at least one edge of the endless belt substrate 10. Moreover, the guide member 100 is provided on at least one edge of the endless belt substrate 10 with an adhesive layer 30 disposed therebetween.

The abutment of the guide member 100 has a contact surface 41 that contacts the edge surface of the endless belt substrate 10, an extended section 43 that extends beyond the edge of the endless belt substrate 10, and a support surface that contacts one side of the endless belt substrate 10. Moreover, the adhesive layer 30 mentioned above is provided on top of this support surface. In FIG. 3, an adhesive layer is not provided on the contact surface 41 in consideration of ensuring a higher degree of positioning precision, but the present invention is not limited to this case, and from the viewpoint of durability, an ultra thin adhesive layer may also be provided on the contact surface 41.

Moreover, in order to improve the bonding of the guide member 100 to the endless belt substrate 10, a reinforcing tape 50 may be provided across the other side of the endless belt substrate 10 and the short width surface of the extended section 43 of the guide member 100.

In a similar manner to the adhesive layers 32 and 34 described above, the adhesive layer 30 is preferably an acrylic-based, natural rubber-based, synthetic rubber-based, silicone-based or thermosetting adhesive. Of these, in terms of the adhesion achieved and the cost incurred, acrylic-based adhesives are particularly desirable. The film thickness of the adhesive (the thickness of the adhesive layer) is preferably not less than approximately 5 μm and not more than approximately 100 μm, and is even more preferably not less than approximately 10 μm and not more than approximately 50 μm. If this thickness exceeds approximately 100 μm, then there is a possibility of the adhesive protruding beyond the bonded area. Furthermore, if the thickness is less than approximately 5 μm, then the adhesive strength may be inadequate.

The rib member 20 of the endless belt 300 according to this exemplary embodiment may have a type A durometer hardness measured in accordance with JIS K6253 (1997) that is typically not less than approximately A30 and not more than approximately A90, and is preferably not less than approximately A50 and not more than approximately A80, and even more preferably not less than approximately A65 and not more than approximately A75. If the hardness exceeds approximately A90, then although the elongation during bonding may be minimal and the dimensional accuracy may be favorable, the elasticity may be inadequate to absorb the continuous shearing force generated when the endless belt is driven for a long period of time around the curved surfaces of rollers. Furthermore, if the hardness is less than approximately A30, then the deformation of the guide member caused by the shearing force imparted to the guide member upon meandering of the endless belt may tend to be large, and satisfactory guiding may become difficult. Examples of materials that may be used for the above elastic member include elastic materials and the like having a suitable degree of hardness, such as neoprene rubbers, polyurethane rubbers, silicon rubbers, polyester elastomers, chloroprene rubbers and nitrile rubbers. Of these, if due consideration is also given to factors such as the electrical insulation properties relative to the endless belt, as well as the moisture resistance, solvent resistance, ozone resistance, heat resistance, abrasion resistance, and the adhesion to adhesives, then polyurethane rubbers and nitrile rubbers are particularly preferred. In terms of the shape of a meander prevention guide, this shape may be determined appropriately in accordance with the usage conditions and the like for the endless belt, but in order to ensure a satisfactory meander prevention effect, the cross-section is preferably a substantially rectangular shape, although trapezoidal shapes and semicircular shapes are also possible, and this does not constitute an exhaustive list. Furthermore, in terms of factors such as the meander prevention effect and the durability and the like, the width of the meander prevention guide is typically not less than approximately 3 mm and not more than approximately 10 mm, and is preferably not less than approximately 3 mm and not more than approximately 7 mm. There are no particular restrictions on the thickness of the meander prevention guide, although from the viewpoints of the meander prevention effect and the durability and the like, the thickness is preferably not less than approximately 1 mm and not more than approximately 5 mm.

Figure 4:
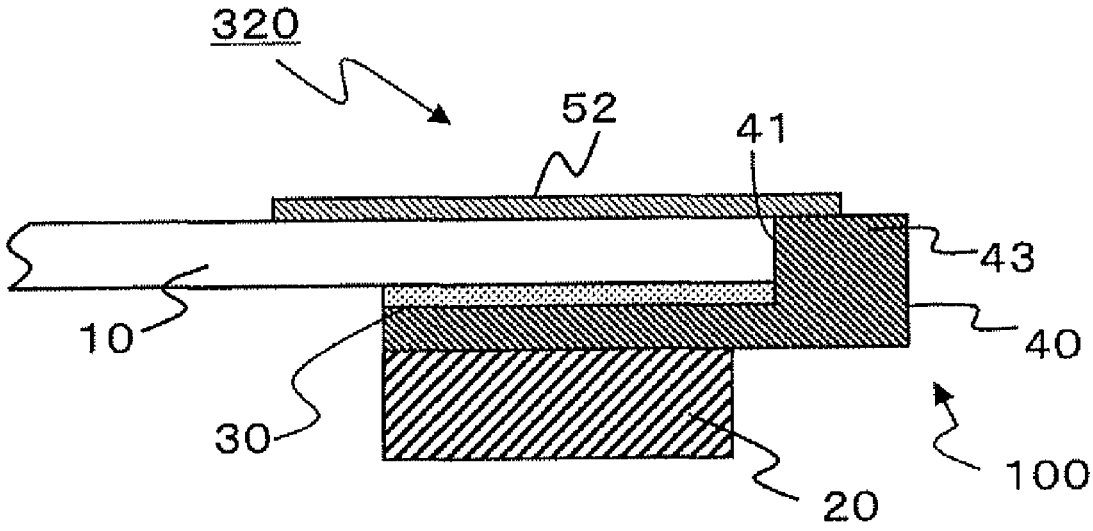
FIG. 4 is a schematic cross-sectional view showing another example of an endless belt according to an exemplary embodiment of the present invention.

FIG. 4 shows another endless belt 320 according to an exemplary embodiment of the present invention. With the exception of the fact that a reinforcing tape 52 is provided across the other side of the endless belt substrate 10 and only a portion of the short width surface of the extended section 43 of the guide member 100, the endless belt 320 has the same structure as that of the endless belt 300 described above. The surface area over which the reinforcing tape 52 is bonded may be adjusted, as long as the bonding of the guide member 100 to the endless belt substrate 10 and the resulting strength are satisfactory.

Figure 5:
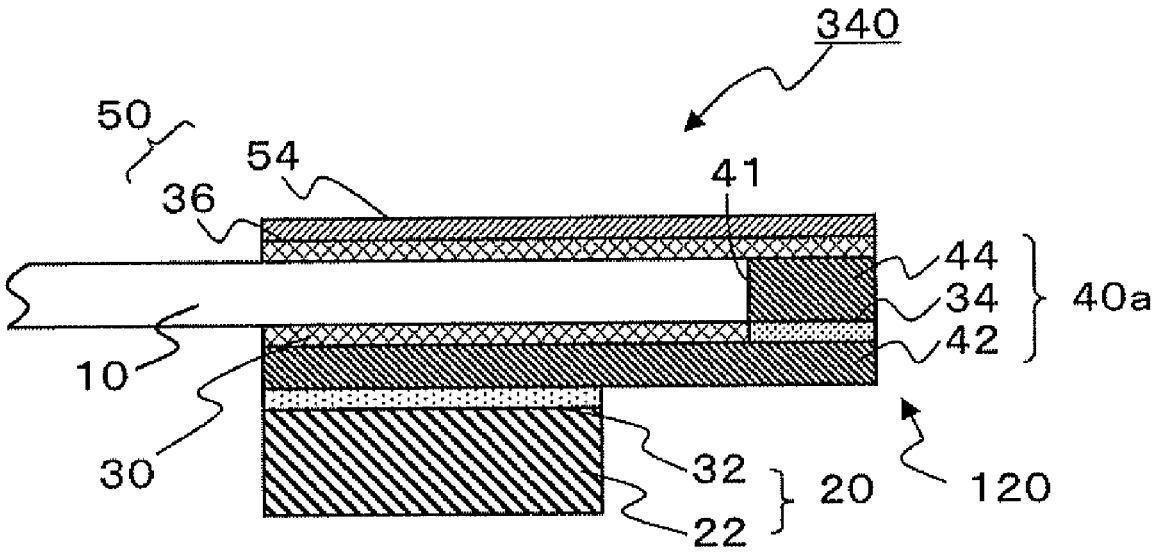
FIG. 5 is a schematic cross-sectional view showing yet another example of an endless belt according to an exemplary embodiment of the present invention.

Yet another endless belt 340 according to an exemplary embodiment of the present invention shown in FIG. 5 includes an endless belt substrate 10, and a guide member 120 that is provided with a rib member 20 and also has an abutment that is abutted against an edge of the endless belt substrate 10, wherein the abutment of the guide member 120 is abutted against at least one edge of the endless belt substrate 10. Moreover, the guide member 120 is provided on at least one edge of the endless belt substrate 10 with an adhesive layer 30 disposed therebetween.

The abutment of the guide member 120 has a first film 44 that contacts the edge surface of the endless belt substrate 10, and a second film 42 that contacts one surface of the first film 44 and also contacts one side of the endless belt substrate 10. Moreover, the adhesive layer 30 described above is provided on the surface of the second film 42 that contacts the endless belt substrate 10. In FIG. 5, an adhesive layer is not provided on the contact surface 41 in consideration of ensuring a higher degree of positioning precision, but the present invention is not limited to this case, and from the viewpoint of durability, an ultra thin adhesive layer may also be provided on this contact surface 41.

Moreover, in order to improve the bonding of the guide member 120 to the endless belt substrate 10 and the resulting strength, a reinforcing tape 50 may be provided across the other side of the endless belt substrate 10 and the width surface of the first film 44 of the guide member 120. The reinforcing tape 50 may be composed of a resin tape 54 and an adhesive layer 36.

The resin tape 54 may be a tape formed from a fluororesin, polyimide resin or biaxially oriented polyester or the like, and preferably has a thickness of not more than approximately 100 μm. If the thickness exceeds approximately 100 μm, then when the belt is used within an image forming apparatus or electrophotographic apparatus or the like, there is a possibility that the tape may contact the cleaning blade.

In a similar manner to the adhesive layers 32 and 34 described above, the adhesive layer 36 is preferably an acrylic-based, natural rubber-based, synthetic rubber-based, silicone-based or thermosetting adhesive. Of these, in terms of the adhesion achieved and the cost incurred, acrylic-based adhesives are particularly desirable. The coating thickness of the adhesive (the thickness of the adhesive layer) is preferably not less than approximately 5 μm and not more than approximately 100 μm, and is even more preferably not less than approximately 10 μm and not more than approximately 50 μm. If this thickness exceeds approximately 100 μm, then there is a possibility of the adhesive protruding beyond the bonded area. Furthermore, if the thickness is less than approximately 5 μm, then the adhesive strength may be inadequate. The width of the adhesive layer 36 may be substantially equal to that of the guide member 120. An example of a reinforcing tape 54 composed of this type of resin tape 54 and adhesive layer 36 is the polyester pressure-sensitive adhesive tape No. 31 (manufactured by Nitto Denko Corporation), and this tape may be used.

The rib elastic member 22 of the rib member 20 on the endless belt 340 according to this exemplary embodiment may have a type A durometer hardness measured in accordance with JIS K6253 (1997) that is typically not less than approximately A30 and not more than approximately A90, and is preferably not less than approximately A50 and not more than approximately A80, and even more preferably not less than approximately A65 and not more than approximately A75. If the hardness exceeds approximately A90, then although the elongation during bonding may be minimal and the dimensional accuracy may be favorable, the elasticity may be inadequate to absorb the continuous shearing force generated when the endless belt is driven for a long period of time around the curved surfaces of rollers. Furthermore, if the hardness is less than approximately A30, then the deformation of the guide member caused by the shearing force imparted to the guide member upon meandering of the endless belt may tend to be large, and satisfactory guiding may become difficult. Examples of materials that may be used for the above elastic member include elastic materials and the like having a suitable degree of hardness, such as neoprene rubbers, polyurethane rubbers, silicon rubbers, polyester elastomers, chloroprene rubbers and nitrite rubbers. Of these, if due consideration is also given to factors such as the electrical insulation properties relative to the endless belt, as well as the moisture resistance, solvent resistance, ozone resistance, heat resistance, abrasion resistance, and the adhesion to adhesives, then polyurethane rubbers and nitrile rubbers are particularly preferred. In terms of the shape of a meander prevention guide, this shape may be determined appropriately in accordance with the usage conditions and the like for the endless belt, but in order to ensure a satisfactory meander prevention effect, the cross-section is preferably a substantially rectangular shape, although trapezoidal shapes and semicircular shapes are also possible, and this does not constitute an exhaustive list. Furthermore, in terms of factors such as the meander prevention effect and the durability and the like, the width of the meander prevention guide is typically not less than approximately 3 mm and not more than approximately 10 mm, and is preferably not less than approximately 3 mm and not more than approximately 7 mm. There are no particular restrictions on the thickness of the meander prevention guide, although from the viewpoints of the meander prevention effect and the durability and the like, the thickness is preferably not less than approximately 1 mm and not more than approximately 5 mm.

Figure 6:
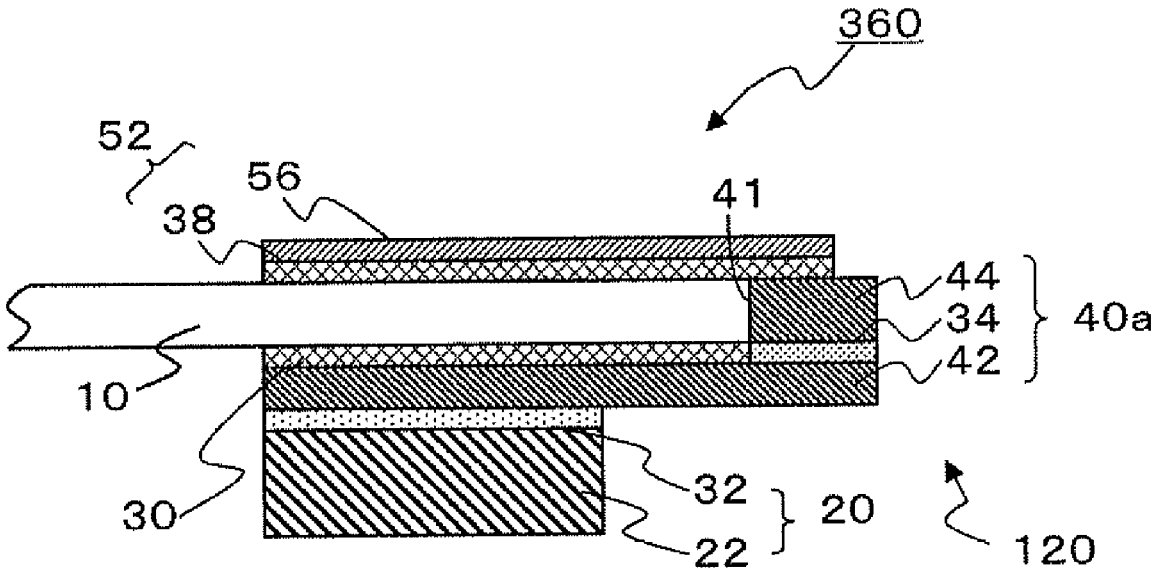
FIG. 6 is a schematic cross-sectional view showing yet another example of an endless belt according to an exemplary embodiment of the present invention.

FIG. 6 shows the structure of yet another endless belt 360 according to an exemplary embodiment of the present invention. With the exception of the fact that a reinforcing tape 52 is provided across the other side of the endless belt substrate 10 and only a portion of the width surface of the first film 44 of the guide member 120, the endless belt 360 has the same structure as that of the endless belt 340 described above. With the exception of the fact that the reinforcing tape 52 is composed of a resin tape 56 and an adhesive layer 38 that have a narrower width than the resin tape 54 and the adhesive layer 36 respectively, the reinforcing tape 52 has the same structure as that of the reinforcing tape 50. Further, the surface area over which the reinforcing tape 52 is bonded may be adjusted, as long as the bonding of the guide member 120 to the endless belt substrate 10 and the resulting strength are satisfactory.

[Method of Producing Endless Belt]

Figure 7:
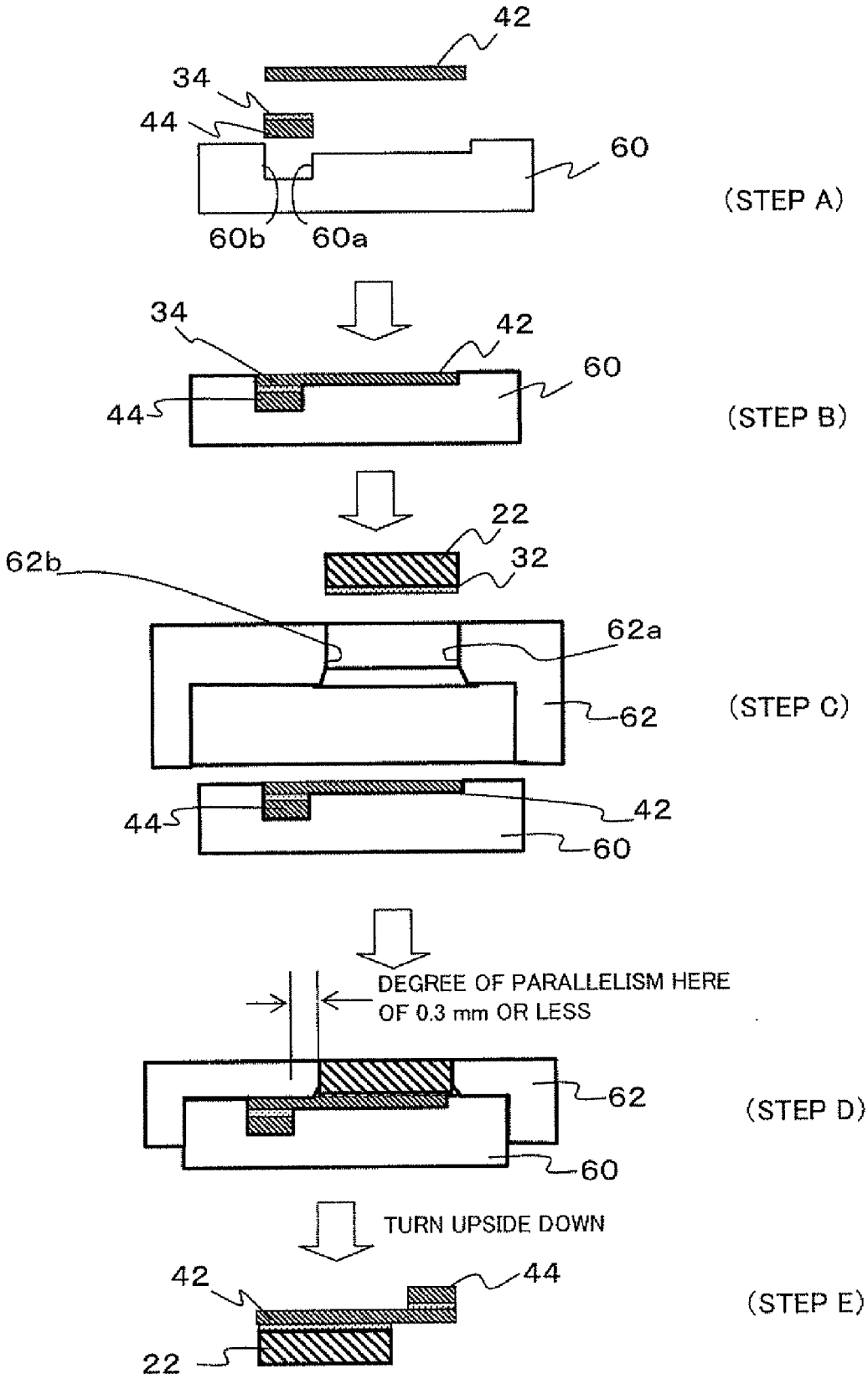
FIG. 7 is an illustration describing steps A through E in an example of a method of producing a guide member according to an exemplary embodiment of the present invention, and an example of a method of producing an endless belt according to an exemplary embodiment of the present invention.
Figure 8:
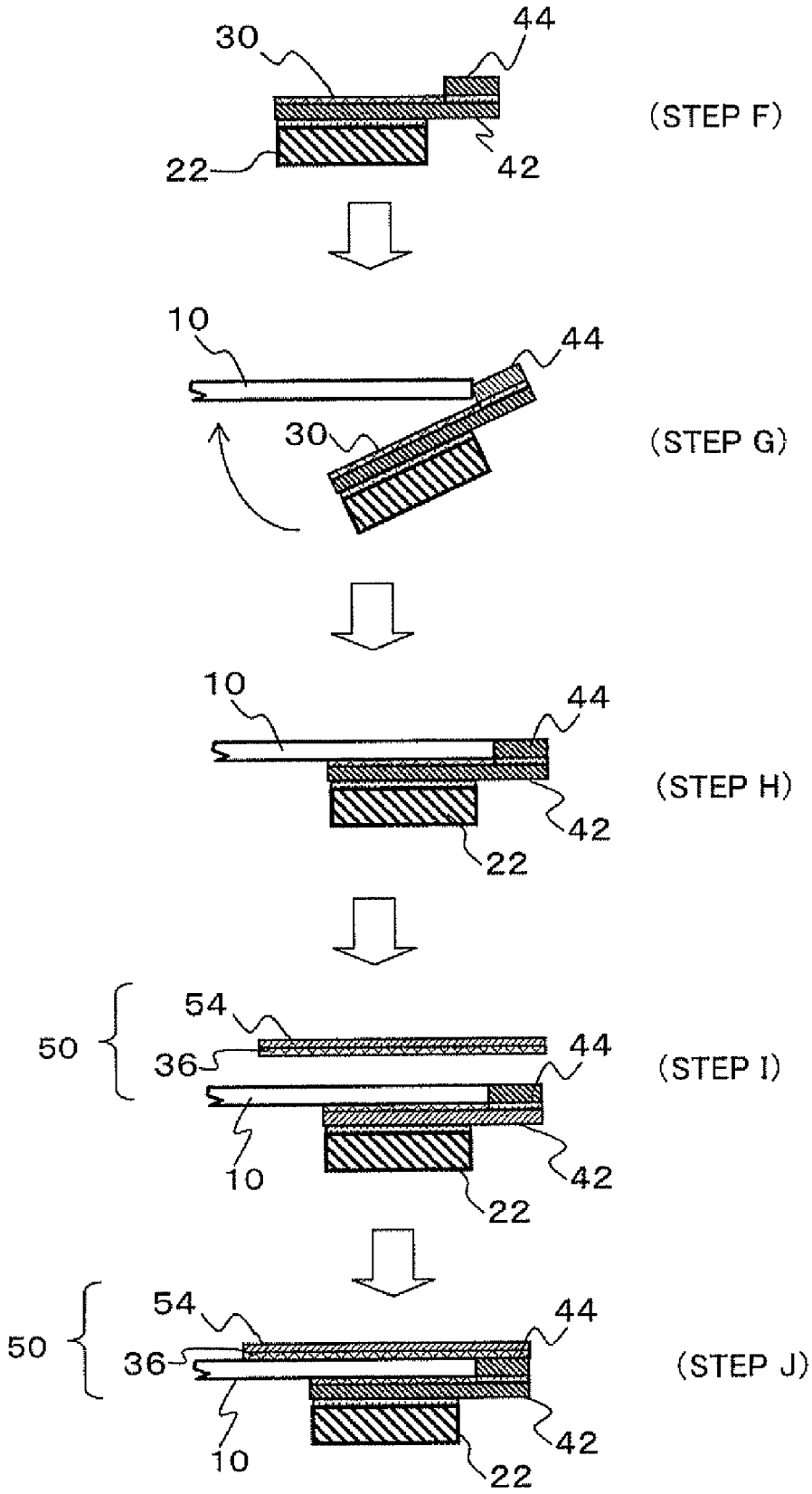
FIG. 8 is an illustration describing steps F through J in an example of a method of producing an endless belt according to an exemplary embodiment of the present invention.

Next is a description of an example of a method of producing an endless belt according to an exemplary embodiment of the present invention, with reference to FIG. 7 and FIG. 8. The guide member 120 shown in FIG. 2 may be produced using the production method shown in FIG. 7.

First, an example of the production of the guide member 120 (FIG. 2) is described with reference to FIG. 7. The first film 44 with the adhesive layer 34 formed on one surface thereof is inserted between side surfaces 60*a* and 60*b* of a deep channel within a first jig 60 that functions as a trimming die such as a Thompson die or the like. Subsequently, the second film 42 is inserted within a shallow channel (Step A), and the first film 44 and the second film 42 are bonded together via the adhesive layer 34 (Step B).

A second jig 62 is then engaged on top of the first jig, and the rib elastic member 22 with the adhesive layer 32 formed on one surface thereof is inserted between side surfaces 62*a* and 62*b* of an opening within the second jig 62 (Step C). The second film 42 and the rib elastic member 22 are then bonded together via the adhesive layer 32 (Step D). At this time, the degree of parallelism between the edge surface of the rib elastic member 22 that constitutes the rib member and the edge surface of the first film 44 is not more than approximately 0.3 mm. Here, the "degree of parallelism" is based upon the "degree of parallelism" defined in the "Definitions and Indications of Geometric Deviation" described in JIS B0621.

Figure 15:
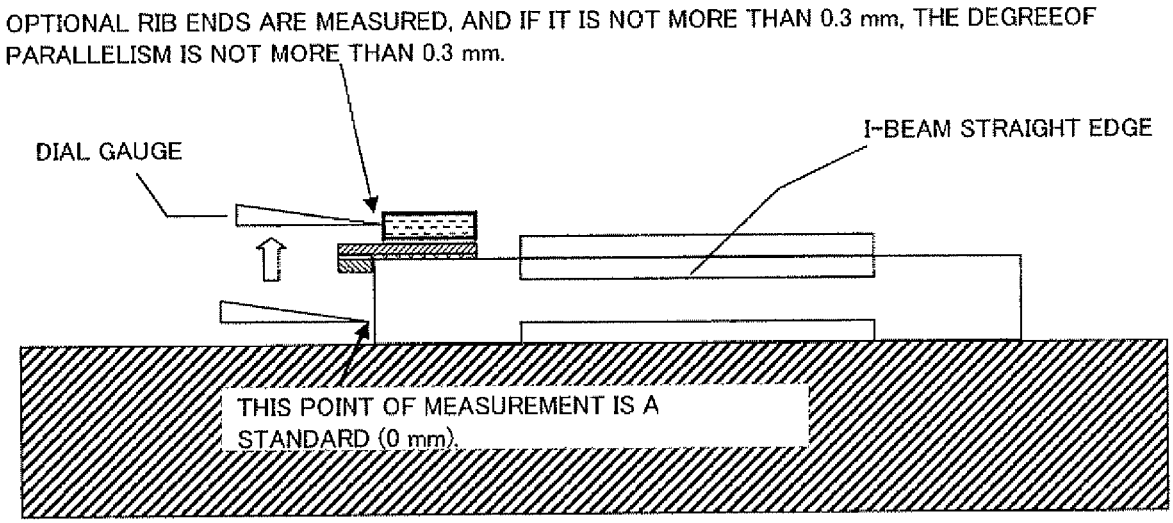
FIG. 15 is an illustration describing an example of a method of measuring the degree of parallelism.

As shown in FIG. 15, measurement of the degree of parallelism may be conducted by bringing the edge surface of the first film 44 into contact with an I-beam straight edge prescribed in JIS B7514 (1977) sitting on a surface plate, measuring the distance from the surface of the I-beam straight edge against which the first film 44 is abutted to the edge surface of the rib elastic member 22 using a dial gauge, and then calculating the degree of parallelism from this distance as prescribed in JIS B0621.

Subsequently, the first jig 60 and the second jig 62 are separated and removed, thereby forming a guide member in which the second film 42, the adhesive layer 34 and the first film 44 are laminated sequentially, via the adhesive layer 32, to the rib member 20 composed of the rib elastic member 22 and the adhesive layer 32 (Step E).

Next is a description of the process of abutting and joining the above guide member 120 (FIG. 2) to the edge of the endless belt substrate, with reference to FIG. 8.

Using the guide member obtained in Step E, the adhesive layer 30 is formed on the opposite surface of the second film 42 from the surface on which the rib member has been formed (Step F).

Subsequently, with the edge of the endless belt substrate 10 abutted against the edge surface of the first film 44 of the guide member 120 (FIG. 2), the guide member is bonded to one surface of the endless belt substrate 10 via the adhesive layer 30 (Step G), thereby joining together the guide member 120 (FIG. 2) and the endless belt substrate 10 (Step H). At this point, the straightness of the edge surface of the first film 44 that is abutted against the endless belt substrate 10 may be not more than approximately 0.2 mm.

Next, the reinforcing tape 50 composed of the resin tape 54 with the adhesive layer 36 formed on one surface thereof is bonded to the joint structure obtained in Step H that includes the guide member 120 (FIG. 2) and the endless belt substrate 10 (Step I). A compressive force is then applied that is appropriate for the material of the adhesive layer 36, thereby bonding the reinforcing tape 50 to the other surface of the endless belt substrate 10 and the width surface of the first film 44 of the guide member 120 (FIG. 2), and yielding an endless belt having a rib member in which the straightness of the rib member is not more than approximately 0.5 mm, and preferably not more than approximately 0.2 mm (Step J).

The endless belt substrate 10 used in the exemplary embodiments is not restricted to the materials described below, but in terms of mechanical properties, is preferably either a crystalline resin such as a polyamide, polyethylene terephthalate, polybutylene terephthalate, syndiotactic polystyrene, polyacetal, polyphenylene sulfide, polyetherketone or polyethernitrile or the like, or an amorphous resin such as a polycarbonate, polysulfone, polyethersulfone, polyetherimide, polyamideimide or polyimide or the like. A polyimide or a polyamideimide is particularly desirable.

(Conductive Agent)

The endless belt may include a conductive agent for the purpose of regulating the resistance. A conductive carbon black, graphite or metal oxide or the like is preferred as the conductive agent, and a conductive carbon black is particularly desirable. A resin belt of an exemplary embodiment of the present invention may be produced by dispersing a carbon black as a conductive material within the above resin that functions as the film-forming resin, thereby imparting the belt with semiconductivity. The blend quantity of the conductive carbon black, in the case of the transfer belt described below, is typically not less than approximately 15 parts by weight and not more than approximately 35 parts by weight, and is preferably not less than approximately 20 parts by weight and not more than approximately 30 parts by weight, per 100 parts by weight of the resin. If the carbon black is not dispersed uniformly and finely, then a belt that has the desired resistance properties and superior retention of surface resistivity may be unobtainable.

If the blend quantity of the uniformly and finely dispersed carbon black is less than approximately 15 parts by weight per 100 parts by weight of the resin, then the resistance of the transfer member may increase, and toner transfer may become difficult. In contrast, if the quantity of carbon black exceeds approximately 35 parts by weight per 100 parts by weight of the resin, then not only may the resistance become too low, but the film may become more brittle, causing a deterioration in the flexibility.

However, provided the desired electrical resistance can be achieved in a stable manner, materials other than the conductive carbon black mentioned above may also be used, including semiconductive carbon blacks or other conductive or semiconductive fine powders. Examples of the different varieties of carbon black include Ketchen black and acetylene black and the like. Furthermore, there are no particular restrictions on the other conductive particles that may be used, and examples include metals such as aluminum and nickel, metal oxide compounds such as yttrium oxide and tin oxide, and potassium titanate and the like.

Furthermore, addition of an ion conductive material such as LiCl, or a conductive polymer material such as a polyaniline, polypyrrole, polysulfone or polyacetylene or the like is also possible. These materials may be used either alone, or in combinations of two or more different materials.

The blend quantity of these other conductive agents is preferably also within the range described above.

[Image Forming Apparatus]

Figure 9:
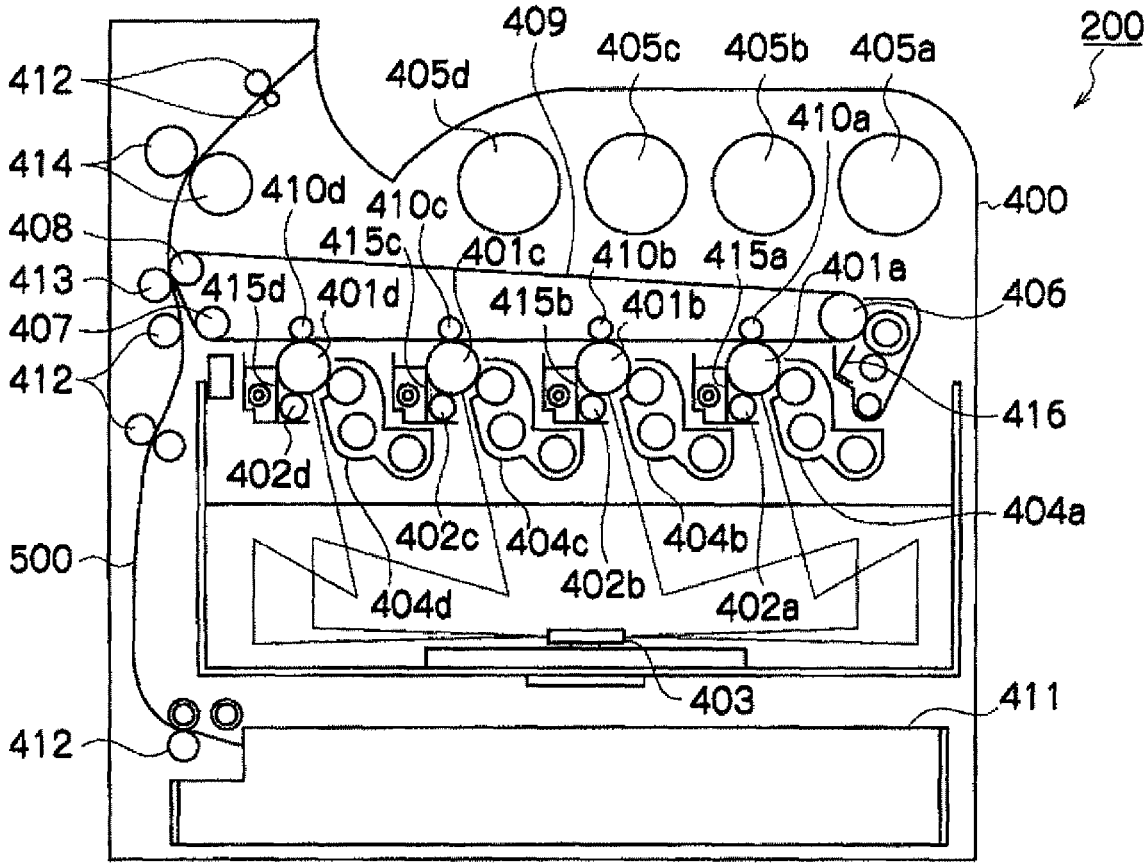
FIG. 9 is a schematic structural view showing an exemplary embodiment of an image forming apparatus of the present invention.

An example of an image forming apparatus according to an exemplary embodiment of the present invention is shown in FIG. 9.

First is a description of an example of the structure of an image forming apparatus with reference to FIG. 9. The image forming apparatus 200 shown in the figure includes four electrophotographic photoreceptors 401*a* to 401*d* positioned in a substantially mutually aligned arrangement along an intermediate transfer belt 409 inside a housing 400. These electrophotographic photoreceptors 401*a* to 401*d*, which function as latent image holding members, may be configured so that, for example, the electrophotographic photoreceptor 401*a* is capable of forming a yellow image, the electrophotographic photoreceptor 401*b* is capable of forming a magenta image, the electrophotographic photoreceptor 401*c* is capable of forming a cyan image, and the electrophotographic photoreceptor 401*d* is capable of forming a black image.

The electrophotographic photoreceptors 401*a* to 401*d* may each be capable of rotating in a predetermined direction (in a counterclockwise direction within the plane of the figure), and around this rotational direction there are provided charging rollers 402*a* to 402*d*, developing units 404*a* to 404*d*, primary transfer rollers 410*a* to 410*d*, and cleaning blades 415*a* to 415*d*. The four colored toners, namely the black, yellow, magenta and cyan toners housed within the toner cartridges 405*a* to 405*d*, can be supplied to the developing units 404*a* to 404*d* respectively. Furthermore, the primary transfer rollers 410*a* to 410*d* may contact the electrophotographic photoreceptors 401*a* to 401*d* respectively across the intermediate transfer belt 409. Each of the charging rollers 402*a* to 402*d* may be a contact-type charging roller that represents one example of the contact charging materials.

An exposure unit 403 can also be positioned at a predetermined location inside the housing 400, and a light beam emitted from the exposure unit 403 can be irradiated onto the surfaces of the charged electrophotographic photoreceptors 401*a* to 401*d*. Accordingly, rotating the electrophotographic photoreceptors 401*a* to 401*d* enables the processes of charging, exposure, developing, primary transfer and cleaning to be conducted in sequence, thereby transferring and superimposing the toner image for each color onto the intermediate transfer belt 409.

In this description, the charging rollers 402*a* to 402*d* can be used for bringing a conductive member (the charging roller) into contact with the surface of the respective electrophotographic photoreceptor 401*a* to 401*d*, thereby applying a uniform voltage to the photoreceptor and charging the photoreceptor surface to a predetermined potential (the charging step). Besides the charging rollers shown in this exemplary embodiment, charging may also be conducted using other contact charging systems that employ charging brushes, charging films or charging tubes or the like.

The exposure unit 403 may employ an optical device or the like that enables a light source such as a semiconductor laser, an LED (light emitting diode) or a liquid crystal shutter or the like to be irradiated onto the surface of the electrophotographic photoreceptors 401*a* to 401*d* with a desired image pattern. Of these possibilities, if an exposure unit that is capable of irradiating noninterference light is used, then the generation of interference fringes between the conductive substrate and the photosensitive layer of the electrophotographic photoreceptors 401*a* to 401*d* can be prevented.

For the developing units 404*a* to 404*d*, typical developing units that use a two-component electrostatic latent image developer to conduct developing via either a contact or non-contact process may be used (the developing step). There are no particular restrictions on these types of developing units, provided they use a two-component electrostatic latent image developer, and appropriate conventional units may be selected in accordance with the desired purpose.

In the primary transfer step, a primary transfer bias of the reverse polarity to the toner supported on the image holding member is applied to the primary transfer rollers 410*a* to 410*d*, thereby effecting sequential primary transfer of each of the colored toners to the intermediate transfer belt 409.

The cleaning blades 415*a* to 415*d* can be used for removing residual toner adhered to the surfaces of the electrophotographic photoreceptors following the transfer step, and the resulting surface-cleaned electrophotographic photoreceptors may then be reused within the above image forming process. Examples of materials that may be used for the cleaning blades include urethane rubbers, neoprene rubbers and silicone rubbers and the like.

The intermediate transfer belt 409 can be supported at a predetermined level of tension by a drive roller 406, a backup roller 408 and a tension roller 407, and can be rotated without slack by rotation of these rollers. Furthermore, a secondary transfer roller 413 may be positioned so as to contact the backup roller 408 across the intermediate transfer belt 409.

By applying a secondary transfer bias to the secondary transfer roller 413 that is of the reverse polarity to the toner on the intermediate transfer belt, the toner undergoes secondary transfer from the intermediate transfer belt to the recording medium. After passing between the backup roller 408 and the secondary transfer roller 413, the intermediate transfer belt 409 may be surface-cleaned by either a cleaning blade 416 positioned near the drive roller 406 or a charge neutralizing device (not shown in the figure), and can then be reused in the next image forming process. Furthermore, a tray (a transfer target medium tray) 411 may be provided at a predetermined position inside the housing 400, and a transfer target medium 500 such as paper stored within this tray 411 can be fed by feed rollers 412 between the intermediate transfer belt 409 and the secondary transfer roller 413, and then between two mutually contacting fixing rollers 414, before being discharged from the housing 400.

In the image forming apparatus of this exemplary embodiment, the aforementioned transfer unit may include the intermediate transfer belt 409 shown in FIG. 9 that supports a toner image, and multiple support rollers, including the drive roller 406, that maintain the tension on the intermediate transfer belt 409 and drive the belt in a rotational manner. The intermediate transfer belt 409 can be an endless belt as exemplified in FIG. 3 through FIG. 6, and a guide member having an abutment and a rib member formed thereon can be provided around at least one side edge of the endless belt. Moreover, at least one of the above support rollers can be provided with a guide roller that is freely rotatable and has a tapered guide surface or the like that contacts and guides the edge of the rib member.

Figure 10:
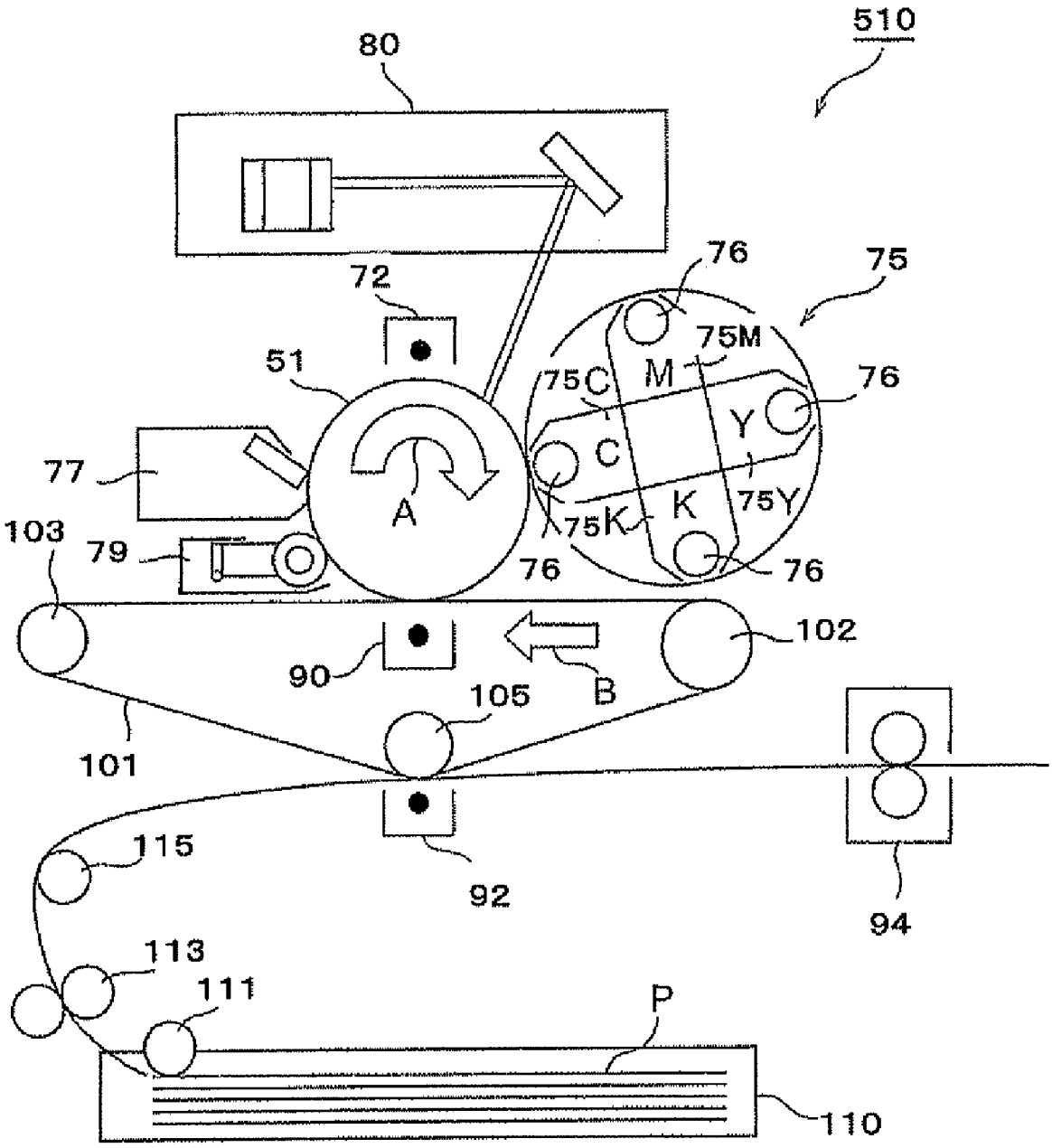
FIG. 10 is a schematic illustration showing an image forming apparatus according to another exemplary embodiment of the image forming apparatus of the present invention.
Figure 11:
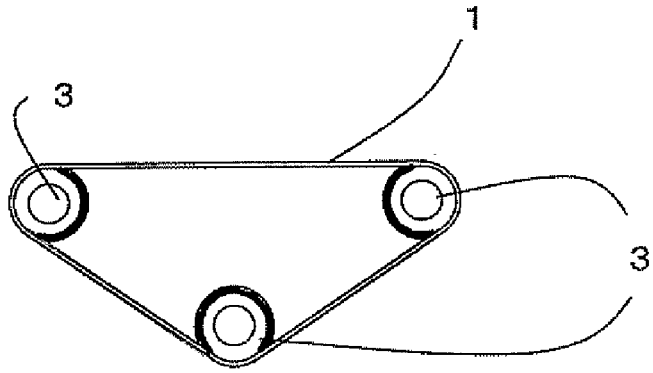
FIG. 11 is a schematic illustration showing an example of an endless belt stretched tightly around drive rollers.

FIG. 10 is a schematic illustration showing an image forming apparatus according to another exemplary embodiment of the present invention. The image forming apparatus 510 shown in FIG. 10 is a so-called four cycle-type image forming apparatus in which toner images of multiple colors can be formed with one electrophotographic photoreceptor. The image forming apparatus 510 may include a photoreceptor drum 51, which is rotated by a drive unit (not shown in the figure) at a predetermined rotational speed in the direction of an arrow A shown in the figure. A charging device 72 that charges the outer peripheral surface of the photoreceptor drum 51 can be provided above the photoreceptor drum 51.

An exposure device 80 equipped with a surface-emitting laser array as the exposure light source can be disposed above the charging device 72. The exposure device 80 can modulate the multiple laser beams emitted from the light source in accordance with the image to be formed, and can deflect them in the main scanning direction, thereby scanning the outer peripheral surface of the photoreceptor drum 51 in a direction almost parallel to the axis of the photoreceptor drum 51. As a result, an electrostatic latent image can be formed on the outer peripheral surface of the charged photoreceptor drum 51.

The developing device 75 can be positioned to the side of the photoreceptor drum 51. The developing device 75 may include a roller-shaped housing that is arranged so as to be rotatable. Four storage units can be formed inside this housing, and developing units 75Y, 75M, 75C and 75K can be provided inside these storage units. The developing units 75Y, 75M, 75C and 75K may each contain a developing roller 76, and can be used for storing colored toners of yellow (Y), magenta (M), cyan (C), and black (K) respectively.

The formation of a full color image using the image forming apparatus 510 may require the photoreceptor drum 51 to form an image for each of the four colors. In other words, during the period while the photoreceptor drum 51 forms four images, an operation can be repeated in which the charging device 72 charges the outer peripheral surface of the photoreceptor drum 51, and the exposure device 80 scans the outer peripheral surface of the photoreceptor drum 51 with laser beams that have been modulated in accordance with the image data for one of the colors Y, M, C or K used to represent the color image being formed. This operation can be repeated for each image formation repetition performed by the photoreceptor drum 51, while the image data used for modulating the laser beams is switched between the four colors. Furthermore, for each image formation repetition performed by the photoreceptor drum 51, the developing device 75 can activate one of the developing units 75Y, 75N, 75C and 75K that is facing the outer peripheral surface of the photoreceptor drum 51, with the developing roller 76 of that particular developing unit facing the outer peripheral surface, thereby developing the electrostatic latent image formed on the outer peripheral surface of the photoreceptor drum 51 into the specified color, and forming a toner image of that specified color on the outer peripheral surface of the photoreceptor drum 51. This operation can be repeated while rotating the housing so as to switch the developing unit used for developing the electrostatic latent image. As a result, Y, M, C and K toner images can be formed sequentially on the outer peripheral surface of the photoreceptor drum 51 with each rotation of the photoreceptor drum 51.

Furthermore, an endless intermediate transfer belt 101 may be positioned beneath the photoreceptor drum 51. The intermediate transfer belt 101 may be wrapped around rollers 102, 103 and 105, and may be arranged so that the outer peripheral surface of the belt is in contact with the outer peripheral surface of the photoreceptor drum 51. The rollers 102, 103 and 105 can be rotated by transmission of a driving force from a motor that is not shown in the figure, thereby rotating the intermediate transfer belt 101 in the direction of the arrow B shown in the figure.

A transfer device (a transfer unit) 90 may be positioned on the opposite side of the intermediate transfer belt 101 to the photoreceptor drum 51, and the Y, M, C and K toner images formed sequentially on the outer peripheral surface of the photoreceptor drum 51 can be transferred by the transfer device 90, one color at a time, to the image formation surface of the intermediate transfer belt 101, so that finally, all four Y, M, C and K toner images can be superimposed on the intermediate transfer belt 101.

Further, a lubricant supply device 79 and a cleaning device 77 may be disposed on the outer peripheral surface of the photoreceptor drum 51, in positions on the opposite side of the photoreceptor drum 51 to the developing device 75. Once the toner image formed on the outer peripheral surface of the photoreceptor drum 51 has been transferred onto the intermediate transfer belt 101, the lubricant supply device 79 can supply a lubricant to the outer peripheral surface of the photoreceptor drum 51, and the area of the outer peripheral surface on which the transferred toner image was held can be cleaned by the cleaning device 77.

A paper supply unit 110 may be positioned beneath the intermediate transfer belt 101, and multiple sheets of a paper P that act as a recording material may be stacked inside this paper supply unit 110. A pickup roller 111 may be positioned at the upper left corner of the paper supply unit 110, and a pair of rollers 113 and a roller 115 may be arranged sequentially downstream in the direction in which the paper P is fed by the pickup roller 111. The sheet of recording paper positioned on the top of the stack of paper can be picked up from the paper supply unit 110 by the rotation of the pickup roller 111, and can then be transported by the pair of rollers 113 and the roller 115.

Furthermore, a transfer device 92 may be positioned on the opposite side of the intermediate transfer belt 101 to the roller 105. A sheet of paper P transported by the pair of rollers 113 and the roller 115 can be fed between the intermediate transfer belt 101 and the transfer device 92, and the transfer device 92 can transfer the toner image formed on the image formation surface of the intermediate transfer belt 101 to the sheet of paper P. A fixing device 94 equipped with a pair of fixing rollers may be positioned on the downstream side of the transfer device 92 in the transport direction of the paper P, and once the transferred toner image has been fused and fixed by the fixing device 94, the paper P bearing the transferred toner image can be ejected from the image forming apparatus 510 and placed on an ejected paper receiver (not shown in the figure).

<Addendum>

The endless belt according to any one of claim 2 through claim 9, wherein the straightness of the edge surface of the abutment of the first film against which the edge of the endless belt substrate is abutted is not more than approximately 0.5 mm, and is preferably not more than approximately 0.2 mm.

EXAMPLES

A more detailed description of the present invention is presented below with reference to a series of examples, but these examples in no way limit the scope of the present invention.

[Method of Producing Endless Belt Substrate]

To an N-methyl-2-pyrrolidone (NMP) solution of a polyamic acid formed from 3,3',4,4'-biphenyltetracarboxylic dianhydride (BPDA) and 4,4'-diaminodiphenyl ether (DDE) (U-Varnish S (solid fraction concentration: 18% by weight), manufactured by Ube Industries, Ltd.) is added a sufficient quantity of a dried oxidized carbon black (SPECIAL BLACK 4, manufactured by Degussa AG, pH: 3.0, volatile fraction: 14.0%) to provide 23 parts by weight of the carbon black per 100 parts by weight of the raw material solid fraction within the solution that is capable of forming a polyimide resin. Using Jet mill(Genus PY, manufactured by Genus Co., Ltd.), an operation composed of separating the resulting mixture into two parts, colliding the two parts at a pressure of 200 MPa and a minimum surface area of 1.4 $mm^2$, and then separating the mixture into two parts again is performed 5 times, thereby mixing in the carbon black and generating a carbon black-containing polyamic acid solution for use in forming the substrate. Using a dispenser, this carbon black-containing polyamic acid solution is applied to the inner surface of a circular cylindrical mold, in sufficient quantity to form a coating thickness of approximately 0.5 mm, and the mold is then rotated at 1,500 rpm for 15 minutes to form a film having a substantially uniform thickness. The mold is then rotated at 250 rpm while the outside of the mold is exposed to a hot air stream at 60° C. for 30 minutes, and then heated at 150° C. for 60 minutes, before the mold is cooled to room temperature, completing formation of the coating film. Subsequently, the coating film formed on the inner surface of the mold is removed, and used to cover the outer periphery of a metal core. The coated core is heated to a temperature of 400° C. at a rate of temperature increase of 2° C./minute, and is then heated at 400° C. for a further 30 minutes, thereby removing residual solvent and cyclodehydration water from the coating, and completing the imide conversion reaction. Following cooling of the core to room temperature, the polyimide film formed on the surface of the metal core is peeled off the core, yielding an endless belt with an outer diameter Φ of 189 mm and a thickness of 80 μm. This endless belt has a surface resistivity of $1\times10^{12}$ ΩD/square and a volume resistivity of $3.2\times10^{9}$ Ωcm.

This belt is mounted on a circular cylindrical jig and cut, and the straightness of the edge surface is 0.1 mm.

Example 1

A guide member of the example 1 is prepared in accordance with the method of producing an endless belt described in FIG. 7 and FIG. 8, and this guide member is used to produce an endless belt. The materials used for each of the structural elements described in these examples and the following comparative example, and the properties of those structural elements are specific to the example or comparative example being described, and in no way limit the various configurations of the present invention.

The prepared guide member and endless belt are measured for the degree of parallelism and straightness using the methods described above.

<Step A>

A second film 42 and a first film 44 are prepared with the shapes and precision described below (not more than 0.1 mm within a Thompson die). An adhesive layer 34 described below is formed on the first film 44.

First film 44: biaxially oriented polyethylene terephthalate film, width: 8 mm, length: 593 mm, straightness: 0.1 mm, thickness: 75 μm.

Second film 42: biaxially oriented polyethylene terephthalate film, width: 3 mm, length: 593 mm, straightness: 0.1 mm, thickness: 50 μm.

Adhesive of the adhesive layer 34: a Double-coated Adhesive Tape "No. 5000NS" (manufactured by Nitto Denko Corporation) that uses an acrylic-based adhesive.

Furthermore, the straightness of the aforementioned first jig 60, which is a Thompson die capable of turning the first film 44 and the second film 42 as a bonded unit, is 0.1 mm or less. The first jig 60 is formed of a material such as aluminum, and is a structure in which the width of the channel in which the first film 44 is set is 0.2 mm larger than the width of the first film 44, and in which the side surfaces 60*a* and 60*b* have been machined to a straightness of not more than 0.05 mm and have a depth of 125 μm. Moreover, the tolerance of the channel in which the second film 42 is set is 0.2 mm or less, and the depth of the channel is 50 μm.

<Step B>

The second film 42 and the first film 44 are bonded together via the adhesive layer 34 inside the first jig 60.

<Step C>

A second jig 62 is then engaged on top of the first jig 60. Subsequently, the rib member 20 (FIG. 2) composed of the rib elastic member 22 described below with an adhesive layer 32 described below formed on the surface thereof is inserted in the opening within the second jig 62. The second jig 62 is machined so that, at this point, the gap between the edge surfaces of the rib elastic member 22 and the side surfaces 62*a* and 62*b* of the opening within the second jig is wider than 0.2 mm, the degree of parallelism between the side surface 62*b* and the side surface 60*a* of the first jig 60 is not more than 0.3 mm, and the engagement gap between the second jig 62 and the first jig 60 is not more than 0.1 mm.

Rib elastic member 22: a thermosetting urethane rubber sheet with a width of 5 mm and a length of 593 mm, prepared by using a Thompson die to cut a thermosetting urethane rubber sheet (TYPLANE TR100-70) manufactured by Tigers Polymer Corporation (type A durometer hardness measured in accordance with JIS K6253 (1997): A70, thickness: 1 mm) to a width of 5 mm with a precision of 0.2 mm or less.

Adhesive layer 32: "Super X No. 8008" (manufactured by Cemedine Co., Ltd.).

<Step D>

The guide member 120 (FIG. 2) set inside the first jig 60 and the second jig 62 is held within the jigs for 6 hours at room temperature.

<Step E>

The guide member 120 (FIG. 2) with the L-shaped base 40*a* (FIG. 2) bonded thereto is removed from the first jig 60 and the second jig 62, completing preparation of the guide member.

In the guide member prepared via the steps described above, measurement of the straightness of the edge surface of the contact surface 41 (FIG. 2) of the first film 44 that is abutted against the edge of the endless belt substrate reveals a result of 0.2 mm. Further, the degree of parallelism between the edge surface 21 of the rib elastic member 22 that is bonded to the second film 42 on the opposite side from the first film 44, and the contact surface 41 of the first film 44 is 0.1 mm.

Next is a description of the process of affixing the guide member 120 (FIG. 2) with the rib member provided thereon to the endless belt substrate 10, with reference to FIG. 8.

<Step F>

An adhesive layer 30 is formed by applying an adhesive described below to the surface of the second film 42 that contacts the endless belt substrate 10.

Adhesive layer 30: "Super X No. 8008" (manufactured by Cemedine Co., Ltd.).

<Step G>

The guide member 120 (FIG. 2) with the adhesive layer 30 applied thereto is bonded to the endless belt substrate 10 with the contact surface 41 of the first film 44 abutted against the edge of the endless belt substrate 10.

Endless belt substrate 10: a polyimide belt produced with an outer diameter Φ of 189 mm, a width of 324 mm, a thickness of 80 μm, and a belt edge surface straightness of 0.1 mm. The method of producing the endless belt substrate is as described above, and as such, is not described here.

<Step H>

The bonded structure is held for 6 hours at room temperature.

<Step J>

A reinforcing tape 50 described below, composed of a resin tape 54 and an adhesive layer 36 and with a width of 8 mm, is bonded to the other surface of the endless belt substrate 10 and the width surface of the first film 44 of the guide member 120 (FIG. 2) by applying only pressure at room temperature.

Reinforcing tape 50: a polyester pressure-sensitive adhesive tape (No. 31, manufactured by Nitto Denko Corporation) is used, in which the thickness of the resin tape section 54 is 50 μm, the thickness of the adhesive layer 36, which is composed of an acrylic-based adhesive, is 30 μm, and the width of the tape is 8 mm.

Ten endless belts produced using the production method of the example 1 described above are cut open, and when a three dimensional measuring device (CP-1057, manufactured by Mitutoyo Corporation) is used to measure the displacement of the rib member 20 (FIG. 5) using the two ends of the rib member 20 (FIG. 5) as reference points, and the straightness is then calculated, six belts are 0.2 mm, and four belts are 0.3 mm, meaning the straightness is 0.5 mm or less in all of the belts.

Using a polyimide belt produced using an endless belt substrate 10 with an outer diameter Φ of 189 mm, a width of 330 mm, a thickness of 80 μm, and a belt edge surface straightness of 0.1 mm, a manual operation is used to affix a rib elastic member 22 formed from a thermosetting urethane rubber sheet with a width of 5 mm and a length of 593 mm [prepared by cutting a thermosetting urethane rubber sheet (TYPLANE TR100-70) manufactured by Tigers Polymer Corporation (type A durometer hardness measured in accordance with JIS K6253 (1997): A70, thickness: 1 mm) to a width of 5 mm] to the endless belt substrate 10 via the adhesive "Super X No. 8008" (manufactured by Cemedine Co., Ltd.) of an adhesive layer 32. Of the ten thus produced endless belts, the above straightness is 0.8 mm for four belts and 0.9 mm for five belts, and only one belt, with a straightness of 0.4 mm, is 0.5 mm or less.

Example 2

Using a second film 42 with a thickness of 200 μm and a first film 44 with a thickness of 80 μm, a guide member is prepared in the same manner as the example 1. The degree of parallelism of this member determined using the measurement method described above is 0.1 mm. With the exception of using this guide member, ten endless belts are produced in the same manner as the example 1. When these ten belts are cut open and the straightness of the rib member 20 (FIG. 5) is measured using the three dimensional measuring device, a result of 0.2 mm is achieved for all ten belts, representing a result of 0.5 mm or less. However, because the level difference between the second film and the polyimide belt is large, the shearing force that acts between the polyimide belt and the second film when the belt is rotated may tend to be concentrated within the polyimide belt, which may increase the possibility of cracking.

Example 3

Using a second film 42 with a thickness of 16 μm and a first film 44 with a thickness of 16 μm, a guide member is prepared in the same manner as the example 1. The degree of parallelism of this member determined using the measurement method described above is 0.2 mm. With the exception of using this guide member, ten endless belts are produced in the same manner as the example 1. The workability is poor for the operation of abutting the polyimide belt against the guide member during bonding of the polyimide belt, and when the ten endless belts are cut open and the straightness of the rib member 20 (FIG. 5) is measured using the three dimensional measuring device, three belts are 0.7 mm, three belts are 0.3 mm, and four belts are 0.4 mm, meaning the straightness is 0.5 mm or less in seven of the belts.

Example 4

Using a second film 42 with a thickness of 20 μm and a first film 44 with a thickness of 20 μm, a guide member is prepared in the same manner as the example 1. The degree of parallelism of this member determined using the measurement method described above is 0.2 mm. With the exception of using this guide member, ten endless belts are produced in the same manner as the example 1. The workability is slightly poor for the operation of abutting the polyimide belt against the guide member during bonding of the guide member to the polyimide belt, and when the ten endless belts are cut open and the straightness of the rib member 20 (FIG. 5) is measured using the three dimensional measuring device, two belts have a straightness of 0.5 mm, and the remaining eight belts have a straightness of 0.4 mm, meaning the straightness is 0.5 mm or less in all of the belts.

Example 5

Using a second film 42 with a thickness of 23 μm and a first film 44 with a thickness of 23 μm, a guide member is prepared in the same manner as the example 1. The degree of parallelism of this member determined using the measurement method described above is 0.2 mm. With the exception of using this guide member, ten endless belts are produced in the same manner as the example 1. When the ten endless belts are cut open and the straightness of the rib member 20 (FIG. 5) is measured using the three dimensional measuring device, five belts are 0.3 mm, and five belts are 0.4 mm, meaning the straightness is 0.5 mm or less in all of the belts.

Example 6

Using a second film 42 with a thickness of 50 μm and a first film 44 with a thickness of 90 μm, a guide member is prepared in the same manner as the example 1. The degree of parallelism of this member determined using the measurement method described above is 0.1 mm. With the exception of using this guide member, ten endless belts are produced in the same manner as the example 1. The workability is poor for the operation of abutting the polyimide belt against the guide member during bonding of the guide member to the polyimide belt, but when the ten endless belts are cut open and the straightness of the rib member 20 (FIG. 5) is measured using the three dimensional measuring device, four belts are 0.5 mm, and six belts are 0.4 mm, meaning the straightness is 0.5 mm or less in all of the belts.

Each of the endless belts obtained in the examples 1 through 6 and the comparative example 1 (in each case, the belt amongst the ten belts that has the largest straightness value) is installed as the intermediate transfer belt in a DocuCentre-II C3000 apparatus (manufactured by Fuji Xerox Co., Ltd.) that has been modified to fit the belt, a one-dot image of yellow, magenta, cyan and black is printed in the same position on a sheet of paper, and the degree of positional displacement is evaluated.

Further, in the case of red, blue and green colors, a 30% halftone image is output, and color irregularity within the image is evaluated visually.

The results are shown in Table 1.

TABLE 1

| | Straightness (mm) | Positional displacement (μm) | Color irregularity |
|---|---|---|---|
| Example 1 | 0.3 | 12 | none |
| Example 2 | 0.2 | 9 | none |
| Example 3 | 0.7 | 39 | none |
| Example 4 | 0.5 | 21 | none |
| Example 5 | 0.4 | 15 | none |
| Example 6 | 0.5 | 22 | none |
| Comparative example 1 | 0.9 | 71 | slight |

Potential applications of the present invention include use within image forming apparatuses such as copying machines and printers and the like that use an electrophotographic method.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A guide member comprising a rib member, and a base member having a first surface, a second surface and a third surface, the rib member provided on the first surface thereof such that the rib member only contacts the first surface of the base member, wherein the second surface contacts a first edge of a target object and the third surface contacts a second edge of the target object.

2. The guide member according to claim 1, wherein the second surface of the base that contacts the first edge of the target object is an abutment that is abutted against the first edge of the target object.

3. The guide member according to claim 2, wherein a degree of parallelism between an abutment-side edge surface of the rib member provided on the guide member, and the abutment is not more than approximately 0.3 mm.

4. An endless belt, comprising:

an endless belt substrate having at least a first edge and a second edge, and a guide member including:

a base member having a first surface, a second surface and a third surface, wherein the second surface and the third surface of the base member contact the endless belt substrate; and a rib member provided on the first surface of the base member such that the rib member only contacts the first surface of the base member, wherein the base member includes an abutment having a surface, the surface of the abutment corresponding to the second surface of the base member, the surface of the abutment being abutted against the first edge of the endless belt substrate.

5. The endless belt according to claim 4, wherein the guide member is provided on at least one edge of the endless belt substrate with an adhesive layer disposed therebetween.

6. The endless belt according to claim 4, wherein the abutment of the guide member comprises an extended section that extends beyond the edge of the endless belt substrate, and a support surface that contacts the second edge of the endless belt substrate.

7. The endless belt according to claim 4, wherein the abutment of the guide member comprises a first film that contacts the first edge surface of the endless belt substrate, and a second film that contacts one side of the first film and also contacts the second edge of the endless belt substrate.

8. The endless belt according to claim 4, wherein a maximum thickness of the guide member is not less than approximately 40 μm and not more than approximately [a thickness of the endless belt substrate+200 μm], a minimum thickness of the guide member is not less than approximately 20 μm and not more than approximately 200 μm, and the second surface of the base member that contacts the first edge of the endless belt has a height that is not less than approximately 20 μm and not more than approximately a thickness of the endless belt substrate.

9. The endless belt according to claim 4, wherein the guide member comprises a second film with a thickness of not less than approximately 20 μm and not more than approximately 200 μm, and a first film with a thickness of not less than approximately 20 μm and not more than approximately a thickness of the endless belt substrate.

10. The endless belt according to claim 6, wherein a degree of parallelism between an edge surface of the rib member provided on the guide member, and the second surface of the base member that contacts the first edge of the endless belt substrate is not more than approximately 0.5 mm.

11. The endless belt according to claim 7, wherein a degree of parallelism between an edge surface of the rib member provided on the guide member, and an edge surface of the first film is not more than approximately 0.5 mm.

12. An image forming apparatus, comprising a latent image forming unit that forms a latent image on a latent image holding member, a developing unit that develops the latent image using an electrostatic latent image developer, a transfer unit that transfers the developed toner image to a transfer target via an intermediate transfer member, and a fixing unit that fixes the toner image on the transfer target, wherein the intermediate transfer member is the endless belt according to claim 4.

13. An image forming apparatus, comprising a latent image forming unit that forms a latent image on a latent image holding member, a developing unit that develops the latent image using an electrostatic latent image developer, a transfer unit that transfers the developed toner image to a transfer target, and a fixing unit that fixes the toner image on the transfer target, wherein the transfer unit comprises either a transfer target transport member that transports the transfer target, or a moving transfer member that transfers the toner image on the latent image holder to the transfer target, and the transfer target transport member or the moving transfer member is the endless belt according to claim 4.

14. A method of producing an endless belt, comprising:

preparing an endless belt substrate, preparing a guide member comprising a rib member and a base member including a first surface, a second surface and a third surface, wherein the second surface and the third surface of the base member contact the endless belt substrate, the rib member is provided on the first surface of the base member such that the rib member only contacts the first surface of the base member, and the base member includes an abutment having a surface, the surface of the abutment corresponding to the second surface of the base member, and abutting the surface of the abutment against at least one edge surface of the endless belt substrate and then bonding the guide member to the endless belt substrate.

15. The method of producing an endless belt according to claim 14, wherein when preparing the guide member, a degree of parallelism between the surface of the abutment that is abutted against the edge surface of the endless belt substrate and the rib member provided on the first surface of the base member is not more than approximately 0.5 mm.

16. The method of producing an endless belt according to claim 14, wherein the guide member comprises a first film that contacts an edge surface of the endless belt substrate, and a second film that contacts one side of the first film and also contacts one side of the endless belt substrate, and when preparing the guide member, a degree of parallelism between a contact surface of the first film of the guide member that is abutted against the edge surface of the endless belt substrate and an edge surface of the rib member provided on the first surface of the base member is not more than 0.5 mm.

* * * * *